US009527127B2

(12) United States Patent
Turner

(10) Patent No.: US 9,527,127 B2
(45) Date of Patent: Dec. 27, 2016

(54) METHOD AND APPARATUS FOR FORMING A CAN END WITH CONTROLLED THINNING OF FORMED PORTIONS OF THE CAN END

(71) Applicant: Alfons Haar, Inc., Springboro, OH (US)

(72) Inventor: Stephen B. Turner, Centerville, OH (US)

(73) Assignee: Alfons Haar, Inc., Springboro, OH (US)

( * ) Notice: Subject to any disclaimer, the term of this patent is extended or adjusted under 35 U.S.C. 154(b) by 0 days.

(21) Appl. No.: 14/269,830

(22) Filed: May 5, 2014

(65) Prior Publication Data

US 2016/0016224 A1 Jan. 21, 2016

(51) Int. Cl.

| | |
|---|---|
| ***B21D 51/38*** | (2006.01) |
| ***B21D 22/24*** | (2006.01) |
| ***B21D 22/06*** | (2006.01) |
| ***B21D 51/44*** | (2006.01) |

(52) U.S. Cl.

CPC ..... *B21D 51/383* (2013.01); *B21D 22/06* (2013.01); *B21D 22/24* (2013.01); *B21D 51/44* (2013.01)

(58) Field of Classification Search

CPC ..... B21D 22/24; B21D 22/26; B21D 22/30; B21D 51/38; B21D 22/22; B21D 51/44

See application file for complete search history.

(56) References Cited

U.S. PATENT DOCUMENTS

| | | | | |
|---|---|---|---|---|
| 7,143,623 | B1 | 12/2006 | Turnbull et al. | |
| 2005/0044920 | A1 | 3/2005 | McClung | |
| 2010/0089116 | A1 | 4/2010 | Stodd | |
| 2012/0067102 | A1 * | 3/2012 | Stodd | B21D 51/44 72/351 |
| 2016/0059297 | A1 | 3/2016 | Dunwoody et al. | |

FOREIGN PATENT DOCUMENTS

| | | | |
|---|---|---|---|
| EP | 0340955 | A1 | 11/1989 |
| WO | 2013057250 | A1 | 4/2013 |

OTHER PUBLICATIONS

Cano Palmero, A.; International Search Report and the Written Opinion of the International Searching Authority; International Application No. PCT/US2015/026092, Jul. 22, 2015; European Patent Office, Rijswijk, Netherlands.

* cited by examiner

*Primary Examiner* — Debra Sullivan
(74) *Attorney, Agent, or Firm* — Stevens & Showalter LLP

(57) ABSTRACT

A can end blank is initially cupped and a central portion of the cup is rolled up with an annular portion of the cup being free formed with limited contact with any tooling except to prevent wrinkling, to prevent overextension of the free formed material and to define a final geometry of the free formed material as the forming press reaches a bottom of its forming stroke. The free forming is performed by controlling the motion of a pre-panel punch using a double action piston so that the pre-panel punch is selectively moved between an extended position for formation of a cup of a cupped can end blank and a retracted position for free forming material between a central portion of the cup and a clamped portion of the cupped can end blank.

14 Claims, 14 Drawing Sheets

METHOD AND APPARATUS FOR FORMING A CAN END WITH CONTROLLED THINNING OF FORMED PORTIONS OF THE CAN END

FIELD OF THE INVENTION

The present invention relates to a manufacturing method and apparatus for forming metallic can ends, and more particularly to a method and apparatus for forming can ends so that formed portions of the can ends have controlled thinning. If uncontrolled, thinning can result in non-uniform stresses within the material resulting in warping or twisting or even fractures within the can ends. While the invention is generally applicable for forming can and other container ends or closures, it will be described herein with reference to forming ends for closing beverage cans for which the invention is particularly applicable and initially being used.

BACKGROUND OF THE INVENTION

Metallic beverage can ends are designed to have a stiffening bead extending around each can end adjacent the circumference or periphery of the can end. This bead typically includes generally vertically extending walls interconnected to one another by a bottom wall to form a channel. The bottom wall can be generally rounded or formed into other geometric profiles.

Beverage can bodies and can ends must be sufficiently strong to withstand high internal pressures and also external forces resulting from shipment and handling. Additionally, they must be manufactured from extremely thin and durable materials such as aluminum and aluminum alloys to reduce costs of manufacturing and weight of the finished products. These seemingly incompatible requirements of high strength and light weight can be accomplished by aggressively working the thin materials using interacting male and female tool combinations. Unfortunately, aggressive material working can lead to inconsistencies within a given contour or geometry of can ends due to excessive stretching or thinning of material from which the can ends are made. Such inconsistencies resulting during formation may diminish strength and alter other characteristics of the can ends.

In the present application, techniques for controlling thinning in formed portions of can ends are illustrated in methods and apparatus for forming can ends from thin stock that exhibit required strength and possess improved consistency.

SUMMARY OF THE INVENTION

In accordance with the teachings of the present application, a can end blank is initially cupped and a central portion of the cup is rolled up with an annular portion of the cup being free formed with limited contact with any tooling except to prevent wrinkling, to prevent overextension of the free formed material and to define a final geometry of the free formed material as the forming press reaches a bottom of its forming stroke. The free forming may be accomplished in accordance with an embodiment by having a pre-panel punch controlled by a dual action piston so that the pre-panel punch can be extended into the upper punch assembly or retracted into the upper punch assembly independent of the motion of the rest of the tooling which is dictated by the motion of the ram or punch assembly of the forming press. The can end geometry is set at the very bottom of the forming stroke of the punch assembly.

In accordance with one aspect of the present invention, a can end is formed with controlled thinning of formed portions of the can end by initially cutting a can end blank from a sheet of material in a forming press. A portion of the can end blank is clamped between a first tool and a second tool in a generally horizontal orientation. A fourth tool is controlled independently of other tools of the forming press to move between an extended position and a retracted position. With the fourth tool in an extended position, a cup is formed in the can end blank with the fourth tool and a fifth tool forming a cupped can end blank. A portion of the cupped can end blank is clamped between a sixth tool and a seventh tool and the fourth tool is retracted. A central portion of an outer surface of the cup contacts an eighth tool to hold the central portion of the cup stationary as the clamped portion of the cupped can end blank is moved downward so that the material between the central portion of the cup and the clamped portion of the cupped can end blank is free formed with limited contact with any of the tools. A lower shelf is provided on the eighth tool to prevent overextension of free formed material.

Currently it is preferred to control the fourth tool by connecting a double acting piston to the fourth tool, providing a force on a first side of the piston to retract the fourth tool, and controlling pressure in a piston control chamber on a second side of the piston opposite to the first side to extend the fourth tool.

The lower shelf may be formed by recessing an outer portion of the eighth tool to a depth so that free formed material contacts the lower shelf, if at all, at the bottom of the forming stroke of the forming press. It is currently preferred to recess the outer portion of the eighth tool such that free formed material contacts the lower shelf, if at all, during about a final 0.002 to 0.004 inch of the forming stroke of the forming press. The third tool, the fifth tool, the seventh tool and the eighth tool define a final geometry of the free formed portion of the cupped can end blank at the bottom of the forming stroke of the forming press.

The method may further comprise positioning the fourth tool within the forming press in accordance with material required to be free formed within the forming press. Positioning the fourth tool within the forming press may comprise spacing the fourth tool relative to a double acting piston of the forming press for example by selecting a spacer that extends between the fourth tool and the piston of the forming press.

In accordance with another aspect of the present invention, a method for free forming a portion of a can end with controlled thinning of formed portions of the can end may comprise providing a forming press having a fixed base and an upper punch assembly that is stroked relative to the fixed base, moving the upper punch assembly of the forming press from a top stroke position toward a bottom stroke position, and controlling a tool in the upper punch assembly of the forming press so that the tool moves between an extended position and a retracted position relative to the upper punch assembly of the forming press. Controlling the tool may comprise connecting a double acting piston to the tool, providing a force on a first side of the piston to retract the tool, and controlling pressure in a piston control chamber on a second side of the piston opposite to the first side to extend the tool. The tool may comprise a pre-panel punch. The method may further comprise forming a lower shelf in the fixed base of the forming press to prevent overextension of free formed material.

In accordance with yet another aspect of the present invention, a method for forming a can end with controlled thinning of formed portions of the can end may comprise cutting a can end blank from a sheet of material in a forming press and clamping a peripheral portion of the can end blank in a generally horizontal orientation. Tooling including a pre-panel punch movable between an extended position and a retracted position is provided. A cup is formed in the can end blank with the tooling including the pre-panel punch in its extended position to form a cupped can end blank. A peripheral portion of the cupped can end blank is clamped in a generally horizontal orientation and the pre-panel punch is moved to its retracted position. A central portion of an outer surface of the cup is contacted with a panel punch to hold the central portion of the cup stationary as the clamped portion of the cupped can end blank is moved downward so that the material between the central portion of the cup and the clamped portion of the cupped can end blank is free formed with limited contact with any tooling of the forming press. A lower shelf is provided on the panel punch to prevent overextension of free formed material, and a final geometry of free formed material is formed as the forming press reaches a bottom of a forming stroke.

In accordance with still another aspect of the invention of the present application, an apparatus for forming a can end in a forming press having a fixed base and an upper punch assembly movable relative to the fixed base, the apparatus operating so that thinning of formed portions of the can end is controlled comprises a draw punch carried by the upper punch assembly of the forming press. A draw pad is supported for movement in the fixed base of the forming press and the draw punch and draw pad are aligned with one another for clamping a peripheral portion of a can end blank. A pre-panel punch is carried by a dual action piston of the upper punch assembly of the forming press. A die center is carried by the upper punch assembly of the forming press with the die center surrounding the pre-panel punch which is controlled to move relative to the die center between an extended position and a retracted position, the pre-panel punch in its extended position engaging the can end blank as the can end blank is clamped between the draw punch and draw pad to form a cup in the can end blank to form a cupped can end blank. A crown ring is supported for movement in the fixed base of the forming press and has an upper surface defining a contour for a crown of the can end. A knockout carried by the upper punch assembly is aligned with the crown ring for engaging a peripheral portion of the cupped can end blank so that the cupped can end blank is clamped between the knockout and the crown ring with an outer surface of the cup extending toward the fixed base. A panel punch is mounted to the fixed base and an inner form die is movably mounted in the fixed base and surrounds the panel punch. The panel punch is positioned and sized so that it contacts a central portion of the outer surface of the cup of the cupped can end blank to hold the central portion of the cup stationary as the clamped portion of the cupped can end blank is moved downward so that material between the central portion of the cup and the clamped portion of the cupped can end blank is free formed with limited contact with any tooling of the forming press. The pre-panel punch is retracted after formation of the cupped can end blank so that the die center extends beyond the pre-panel punch to partially define a final geometry of the free formed material as the forming press reaches a bottom of its forming stroke.

The apparatus may further comprise a lower shelf positioned to prevent overextension of free formed material with the lower shelf being formed on the panel punch. The lower shelf may comprise a recessed outer peripheral portion of the panel punch. The pre-panel punch is positioned within the upper punch assembly of the forming press in accordance with an amount of material required to be free formed within the forming press. It is currently preferred to use a spacer between the pre-panel punch and the dual action piston of the upper punch assembly of the forming press to position the pre-panel punch within the upper punch assembly of the forming press.

DETAILED DESCRIPTION OF EMBODIMENTS OF THE INVENTION

The present application discloses methods and apparatus for forming panels, shells or can ends so that formed portions of the can ends have controlled thinning to substantially prevent warping, twisting and/or fractures that can occur if the thinning is uncontrolled. The invention will be described with reference to forming ends for closing beverage cans for which the invention is particularly applicable and initially being used. However, the teachings of the present application can be applied generally for forming can and other container ends or closures as will be apparent to those skilled in the art.

Figure 1:
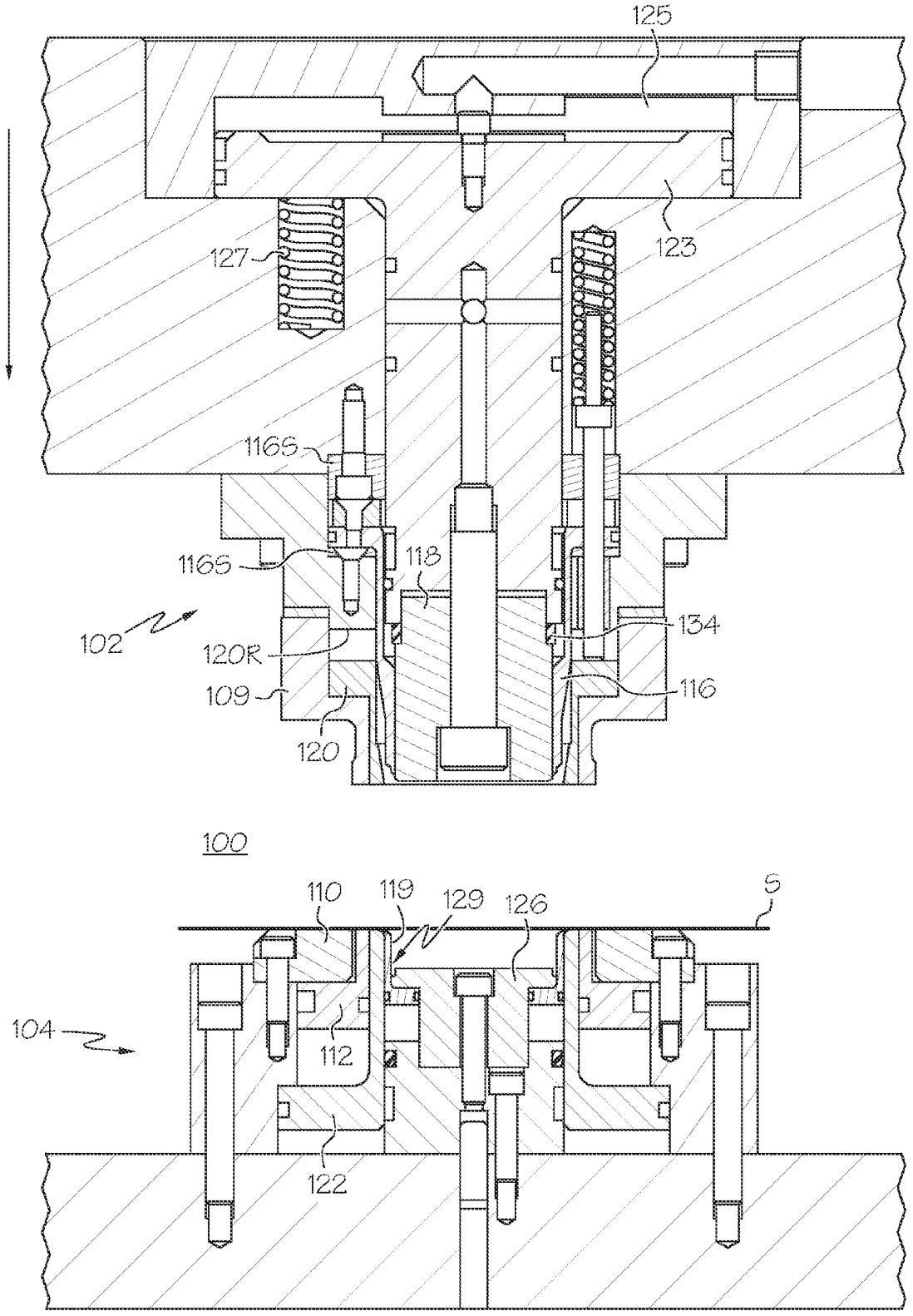
FIG. 1 is a schematic sectional view showing a forming press operable in accordance with the teachings of the present application with the forming press at the top of the stroke of an upper punch assembly which moves generally vertical relative to a fixed base.

Reference is now made to FIG. 1 which illustrates a forming press 100 operable in accordance with the teachings of the present application. FIG. 1 illustrates the forming press 100 at the top of the stroke of an upper punch assembly 102 which moves generally vertical relative to a fixed base 104. An exemplary method for forming a can end with controlled thinning of formed portions of the can end in accordance with the disclosed apparatus and teachings of the present application comprises cutting can end blanks from a sheet of material S in the forming press 100.

Figure 2:
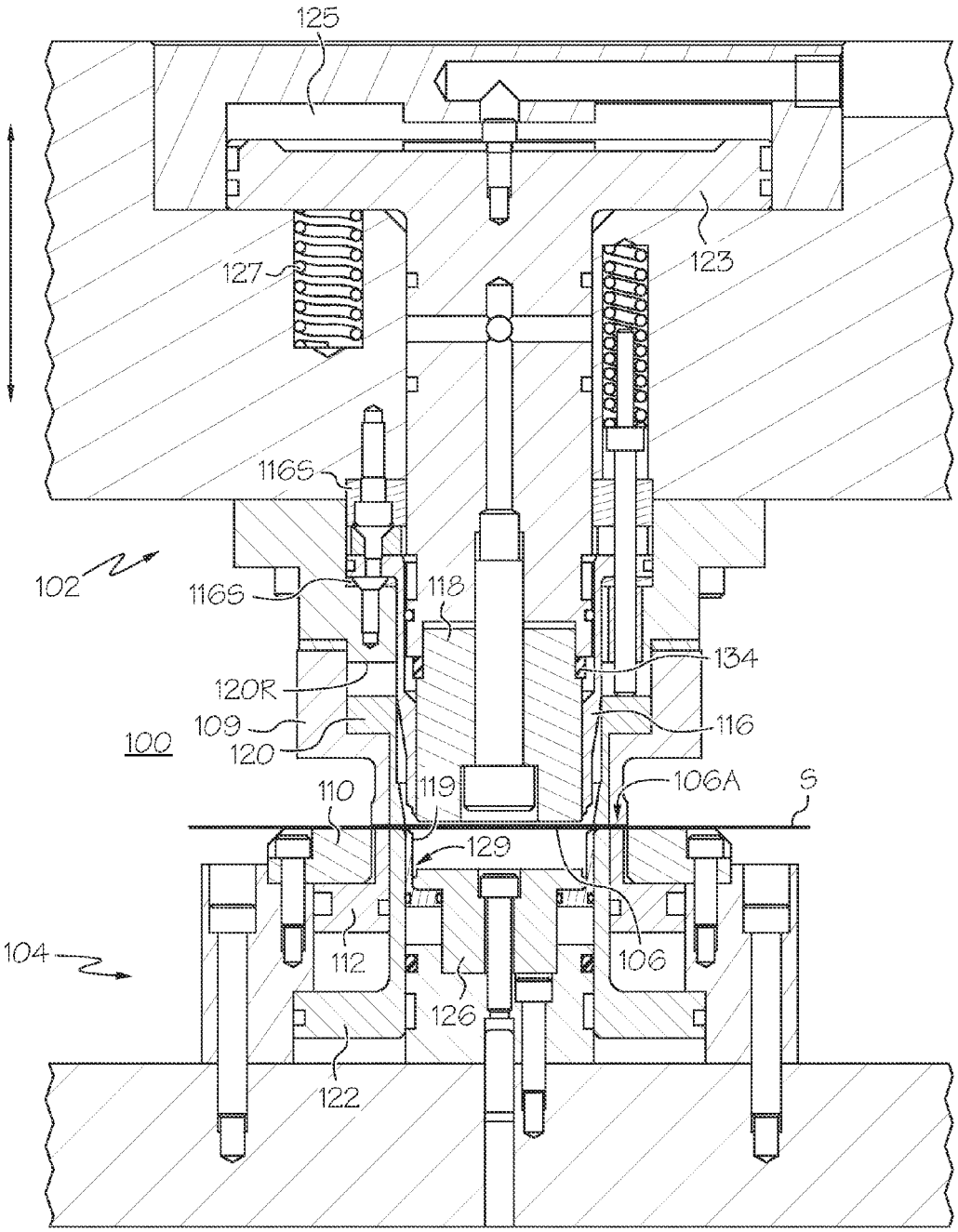
FIG. 2 is a schematic sectional view showing the upper punch assembly moved toward the fixed base to cut a can end blank from a sheet of material.

As shown in FIG. 2, the upper punch assembly 102 is moved toward the fixed base 104 to cut a can end blank 106 from the sheet S. The can end blank 106 is cut from the sheet S by a first tool, a blank or draw punch 109 carried by the upper punch assembly 102, and a cut edge 110 carried by the fixed base 104. An outer periphery portion 106A of the can end blank 106 is clamped between the draw punch 109 and a second tool, a draw pad 112 movably supported in the fixed base 104 of the forming press 100 so that the can end blank 106 is held in a generally horizontal orientation as shown. A third tool, a die center 116 carried by the upper punch assembly 102, is used to finalize the geometry of a can end as the upper punch assembly 102 reaches its bottom of stroke as described herein.

Figure 3:
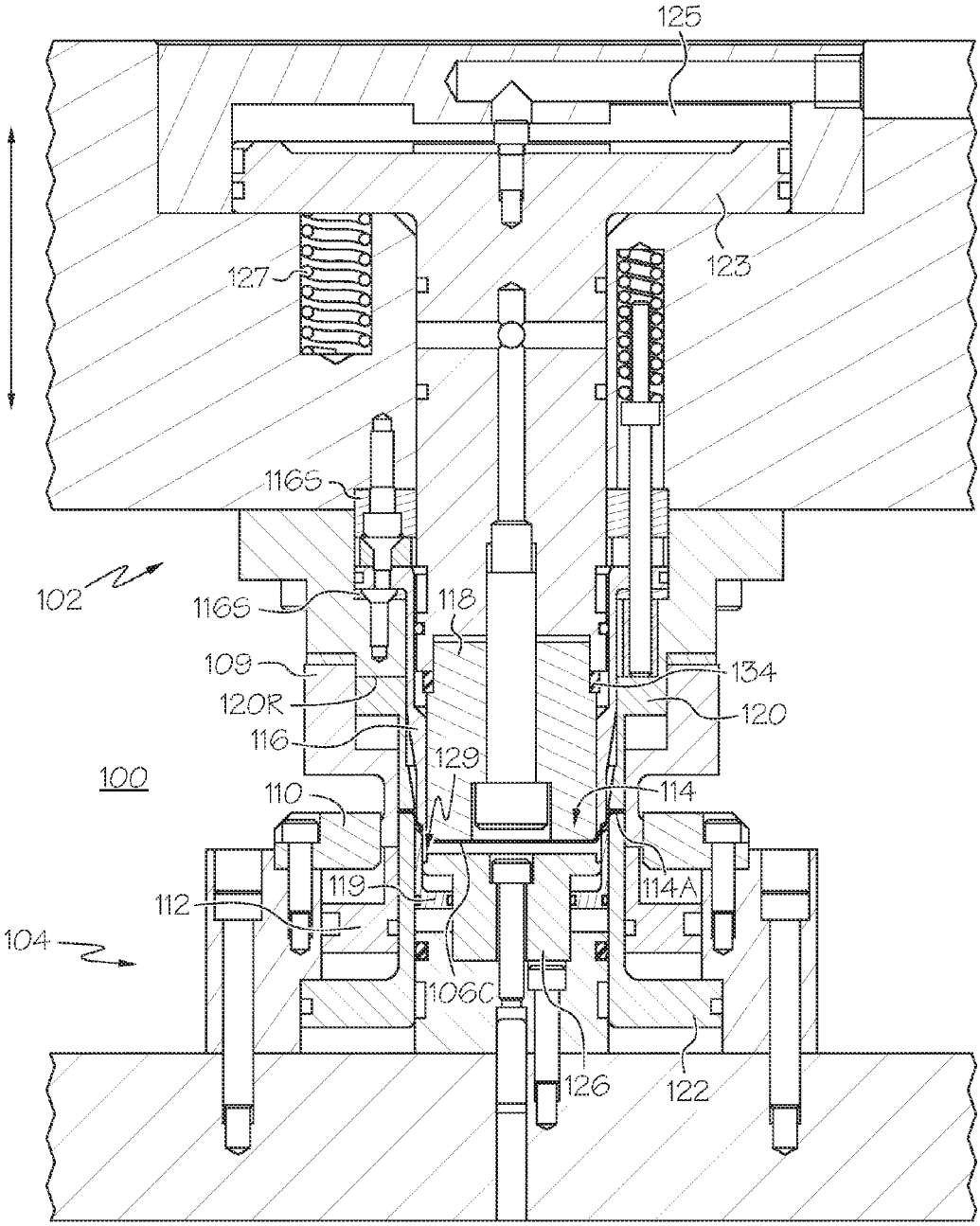
FIG. 3 is a schematic sectional view showing a pre-panel punch of the upper punch assembly in an extended position forming a cup into a can end blank to form a cupped can end blank.
Figure 4:
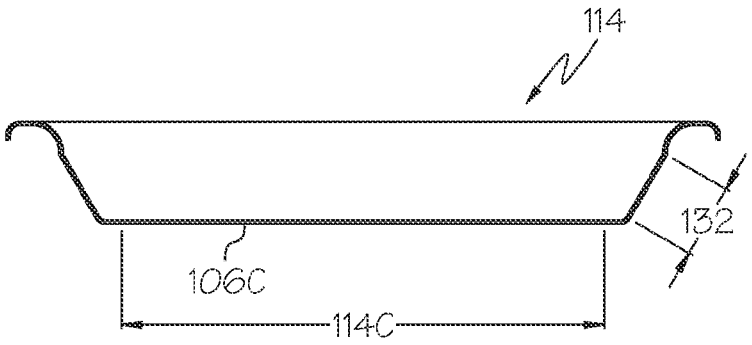
FIG. 4 is an exemplary sectional view of a cupped can end blank.

The can end blank 106 is held in tension by its clamped outer periphery portion 106A as a cup 106C is formed into the can end blank 106 to form a cupped can end blank 114 as shown in FIG. 3 with the cupped can end blank 114 shown in section in FIG. 4. The clamped portion 106A is drawn from the draw punch 109 and the draw pad 112 as the cup 106C is formed. More particularly, a fourth tool, a pre-panel punch 118 carried by the upper punch assembly 102, and a fifth tool, an inner form die 119 movably supported within the fixed base 104, form the cup 106C of the cupped can end blank 114 by tensile flow of the material of the can end blank 106 as best shown in FIG. 3.

An outer peripheral portion 114A of the cupped can end blank 114 is clamped between a sixth tool, a knockout 120 carried by the upper punch assembly 102, and a seventh tool, a crown ring 122. The crown ring 122 is supported for movement in the fixed base 104 of the forming press 100. Movement of the crown ring 122 is controlled by the upper punch assembly 102. More particularly, as the cup 106C is completed, the knockout 120 bottoms out on an upper retainer 120R so that the knockout 120 forces the crown ring 122 down as the upper punch assembly 102 strokes downward.

The pre-panel punch 118 is controlled by a double acting piston 123. As illustrated, the double acting piston 123 is acted upon by a pneumatic force generated above the piston 123 in a piston control chamber 125 to drive the piston 123 downward and by a plurality of mechanical compression springs 127, only one spring being shown in the drawings, to drive the piston 123 upward. The springs 127 can be replaced by a pneumatic force as will be apparent to those skilled in the art. For operation of the forming press 100 to form the cup 106C of the cupped can end blank 114, the pre-panel punch 118 is extended, downward as shown in FIGS. 1-3, by providing pressurized air to the piston control chamber 125 to overcome the force of the springs 127 and provide sufficient force for the cup forming operation.

Figure 5:
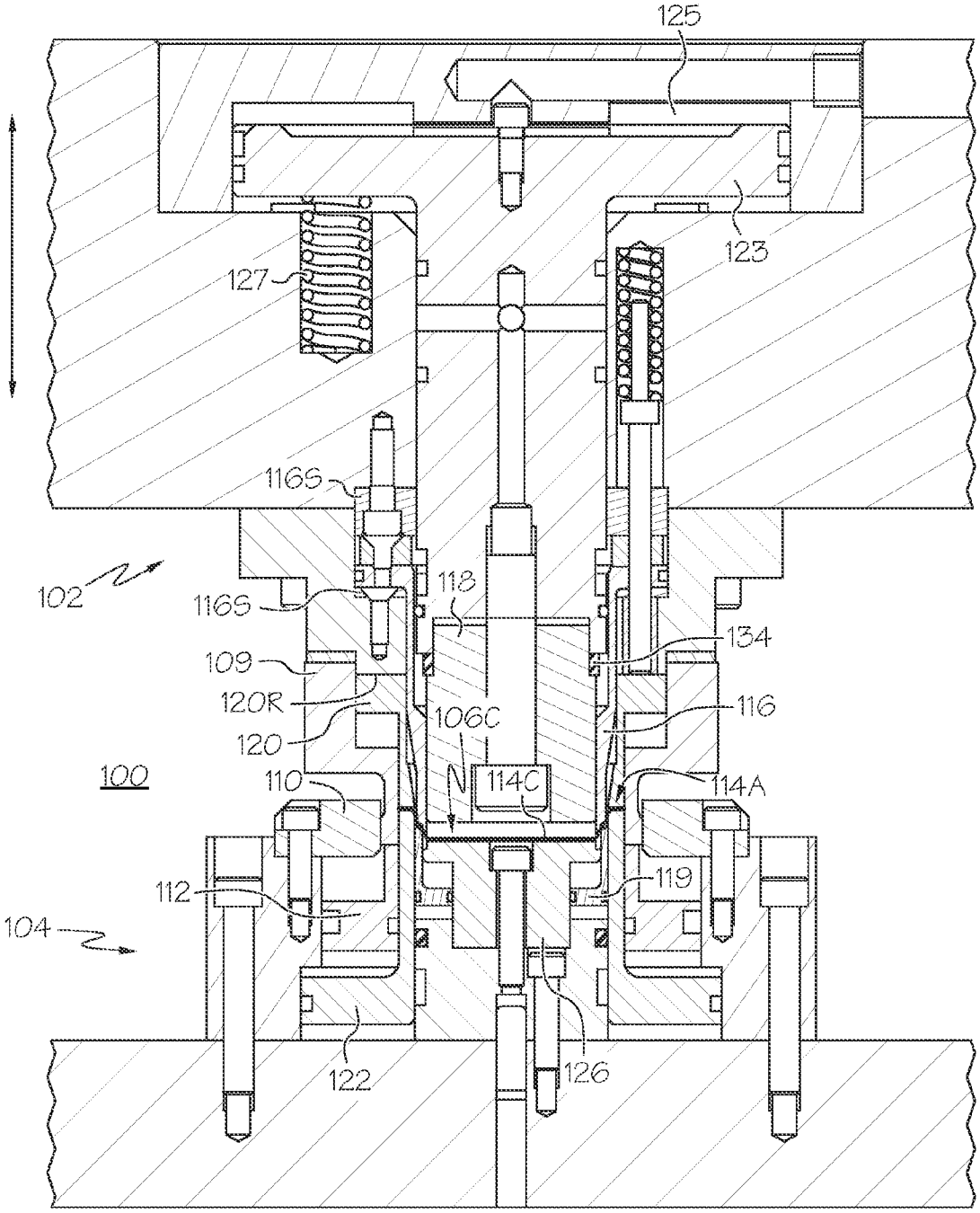
FIG. 5 is a schematic sectional view showing commencement of free forming of the material between a central portion of a cupped can end blank and a clamped portion of the cupped can end blank with the pre-panel punch in a retracted position.

With reference to FIG. 5, as the upper punch assembly 102 moves downward toward the bottom of a forming stroke of the assembly, a central portion 114C of an outer surface of the cup 106C contacts an eighth tool, a panel punch 126, supported in the fixed base 104 of the forming press 100. The panel punch 126 holds the central portion 114C of the cup 106C stationary relative to the forming press 100. The outer peripheral portion 114A of the cupped can end blank 114 clamped between the knockout 120 and the crown ring 122 continues to move downward so that the material between the central portion 114C of the cup 106C and the clamped portion 114A of the cupped can end blank 114 is free formed. The material is free formed with limited or no contact with any of the other tools of the forming press 100. The free formed material does contact the inner form die 119 to prevent wrinkles that may otherwise form in the sidewall of the can end being formed. The motion of the knockout 120 and the crown ring 122 relative to the center portion 114C of the cup 106C may also be referred to as "rolling up" a portion of the cup 106C by those skilled in the art.

Figure 6:
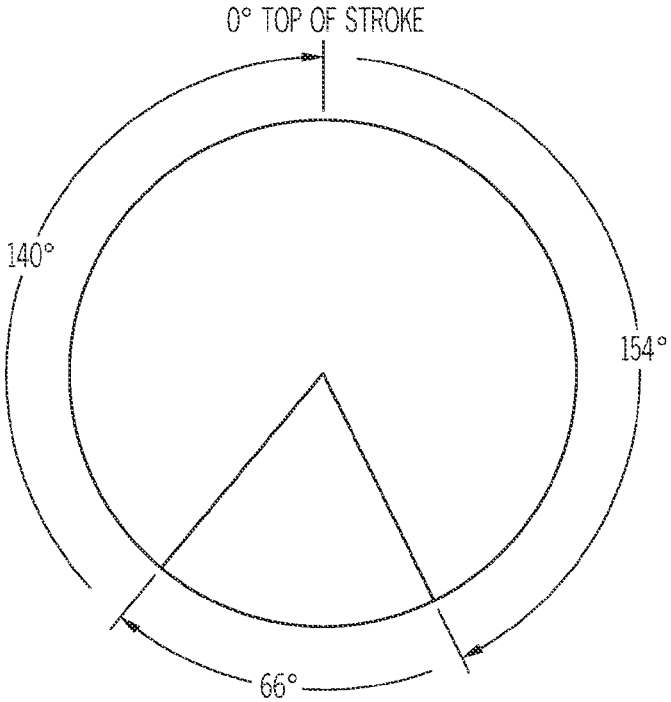
FIG. 6 is diagram illustrating exemplary control of a double acting piston for moving the pre-panel punch between its extended position and its retracted position during operation of the forming press.

The pre-panel punch 118 can be extracted into the upper punch assembly 102 by dumping the pressurized air in the piston control chamber 125 of the double acting piston 123. As shown in FIG. 5, the double acting piston 123 is fully raised so that the pre-panel punch 118 is fully retracted. The complete stroke of the upper punch assembly 102 from the top of stroke through the bottom of stroke and back to the top of stroke is characterized as 360° of travel. An exemplary control diagram for the double acting piston 123, and hence the pre-panel punch 118, is shown in FIG. 6.

From 0° to 154° of travel (154° range), compressed air having sufficient force to extend the pre-panel punch 118 for formation of a cup, such as the cup 106C, is applied to the piston control chamber 125 of the piston 123. The required pressure of the compressed air will depend upon the specific forming press being controlled including the size of the press and tooling, whether springs 127 are used or not, and other common design parameters that will be apparent to those skilled in the art. The use of pneumatic pressure in place of the springs 127 would enable use of lower air pressures for control of the piston 123 since, with a piston raising pneumatic force reduced to substantially zero, there would be no force, such as the force of the springs 127, to be overcome by the pressure in the piston control chamber 125.

Figure 7:
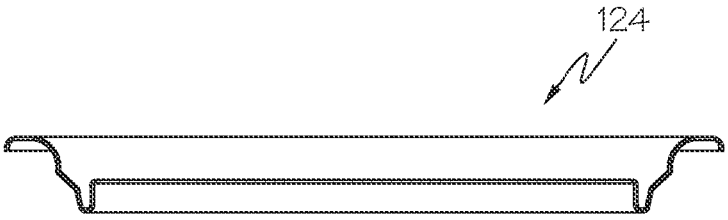
FIG. 7 an exemplary sectional view of a can end formed in accordance with the teachings of the present application.

From 154° to 220° (66° range), the compressed air is dumped from the piston control chamber 125 so that the piston 123 is raised by the springs 127 and the pre-panel punch 118 is retracted for formation of a can end. If the pre-panel punch 118 is not retracted during can end formation, the inertia of the pre-panel punch 118, the pre-panel spacer 134, the piston 123, etc. pushes the formed panel back out on the upstroke of the upper punch assembly 102. For proper formation of can ends, the pre-panel punch must be fully retracted, i.e., in its full up position, as shown in FIG. 5, when the forming press goes past 180° on the upstroke. An exemplary cross section of a can end 124 formed using the teachings of the present application is shown in FIG. 7.

From 220° to 0° or 360° (140° range), compressed air having sufficient force to extend the pre-panel punch 118 for formation of a cup is again applied to the piston control chamber 125 of the piston 123. This range is the start of formation of the next can end.

Figure 8:
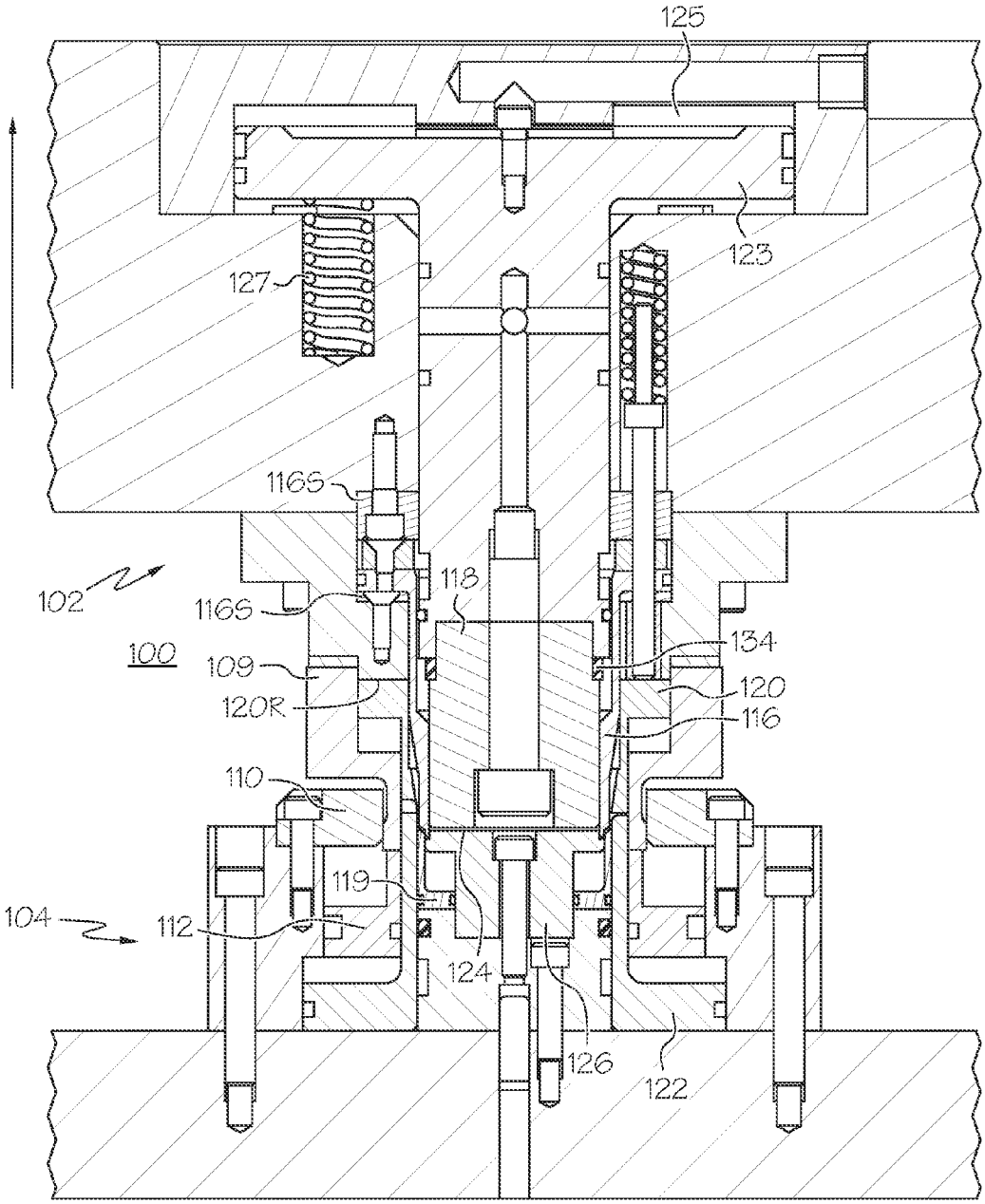
FIG. 8 is a schematic sectional view showing the forming press as the upper punch assembly reaches its bottom of stroke to finalize the geometry of a can end; and, FIGS. 9 thru 16 show roll up of the central portion of the cup to form a finalized can end by a blank being processed in accordance with the teachings of the present application.

The geometry of a can end, such as the can end 124, is finalized by the tooling in the upper punch assembly 102 and the fixed base 104 as the upper punch assembly 102 reaches its bottom of stroke as shown in FIG. 8. The die center 116 extends beyond the retracted pre-panel punch 118 toward a lower shelf 129 defined by the panel punch 126, i.e., the lower shelf 129 comprises a recessed outer peripheral portion of the panel punch 126. As illustrated, the die center 116 together with the panel punch 126, the inner form die 119, the crown ring 122 and the lower shelf 129 define the final geometry of the free formed portion of the cupped can end blank 114 at the bottom of the forming stroke of the forming press 100. See FIG. 7 for an exemplary sectional view of a can end 124 formed in accordance with the teachings of the present application.

The lower shelf 129 is formed so that free formed material contacts the lower shelf 129, if at all, at the bottom of the forming stroke of the forming press 100. In any event, the lower shelf 129 should be formed relative to the other tooling of the forming press 100 so that free formed material contacts the lower shelf 129, if at all, during about a final 0.002 inch (0.0508 mm) to 0.004 inch (0.1016 mm) of the forming stroke of the forming press 100.

Material required for forming a can end, such as the can end 124, is provided by the overall height 132 of the cup 106C the size of which can be adjusted by adjusting the position of the pre-panel punch 118 within the upper punch assembly 102. In the illustrated embodiment, the position of the pre-panel punch 118 is set by a pre-panel punch spacer 134 shown in FIGS. 1-3, 5 and 8. Once the sizing of the pre-panel spacer 134 is determined, the position of the die center 116 may be set as required for proper final formation of the can end at the bottom of the stroke of the upper punch assembly 102. The position of the die center 116 is set by the selection of one or more die center spacers 116S shown in FIGS. 1-3, 5 and 8, which space the die center 116 away from the dual action piston 123.

To summarize, a cup is initially formed in a can end blank to form a cupped can end blank and then a central portion of the cup is reformed or "rolled up" into the cupped can end blank to form a complete can end. This is commonly referred to as "free forming" because the higher strength aluminum alloys normally used are subject to extreme strain thinning and fracture if there is additional contact from tool surfaces during the can end forming process. In accordance with the teachings of the present application, the free forming is accomplished by having the pre-panel punch controlled by a dual action piston so that the pre-panel punch can be extended into the upper punch assembly or retracted into the upper punch assembly independent of the motion of the rest of the tooling which is dictated by the motion of the ram or punch assembly of the forming press. To overcome an issue that can arise during prior art free forming operations, i.e., a lack of defined geometry in the finished can end, the can end geometry is set at the very bottom of the forming stroke of the punch assembly.

Figure 9:
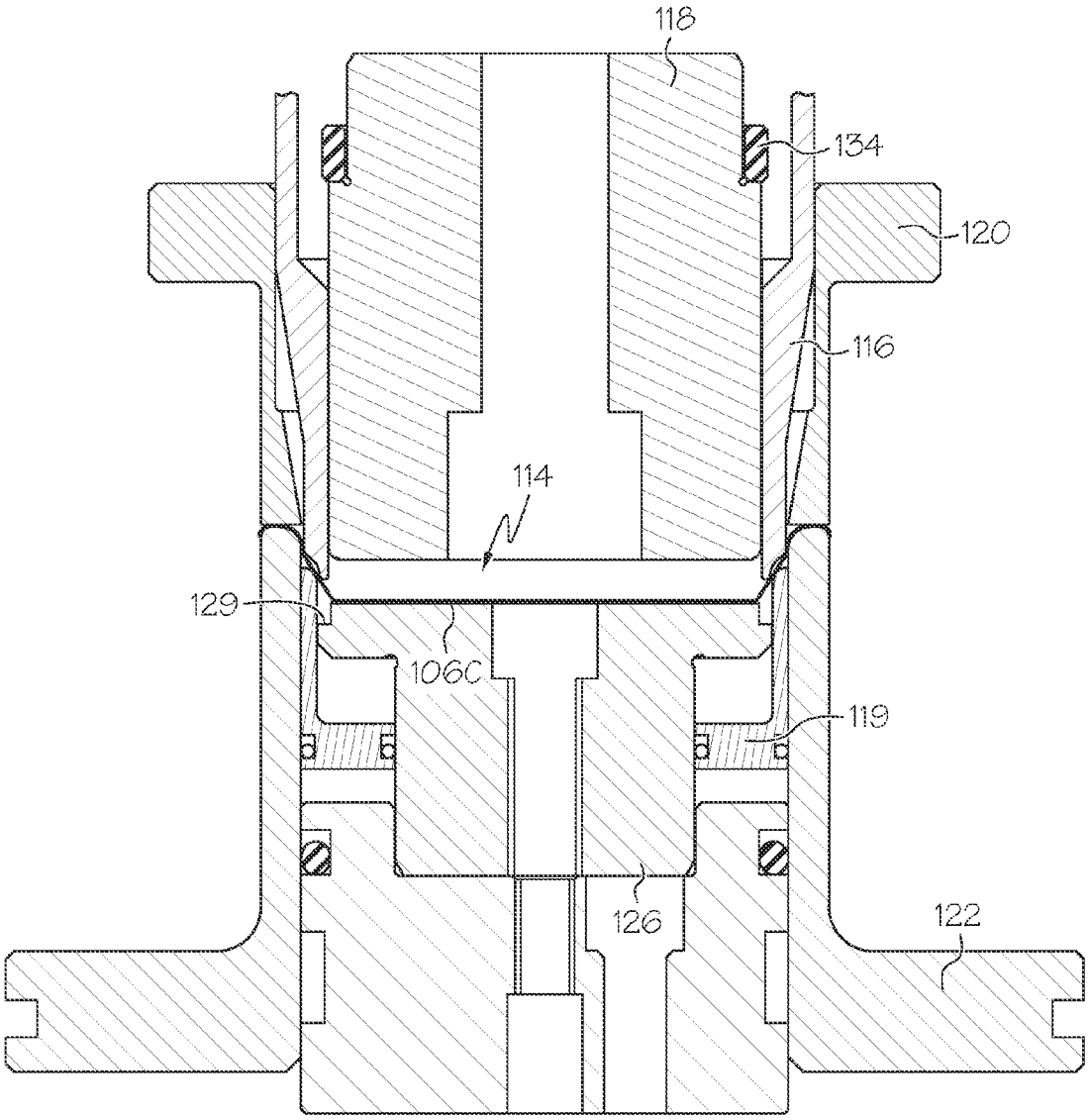
Figure 10:
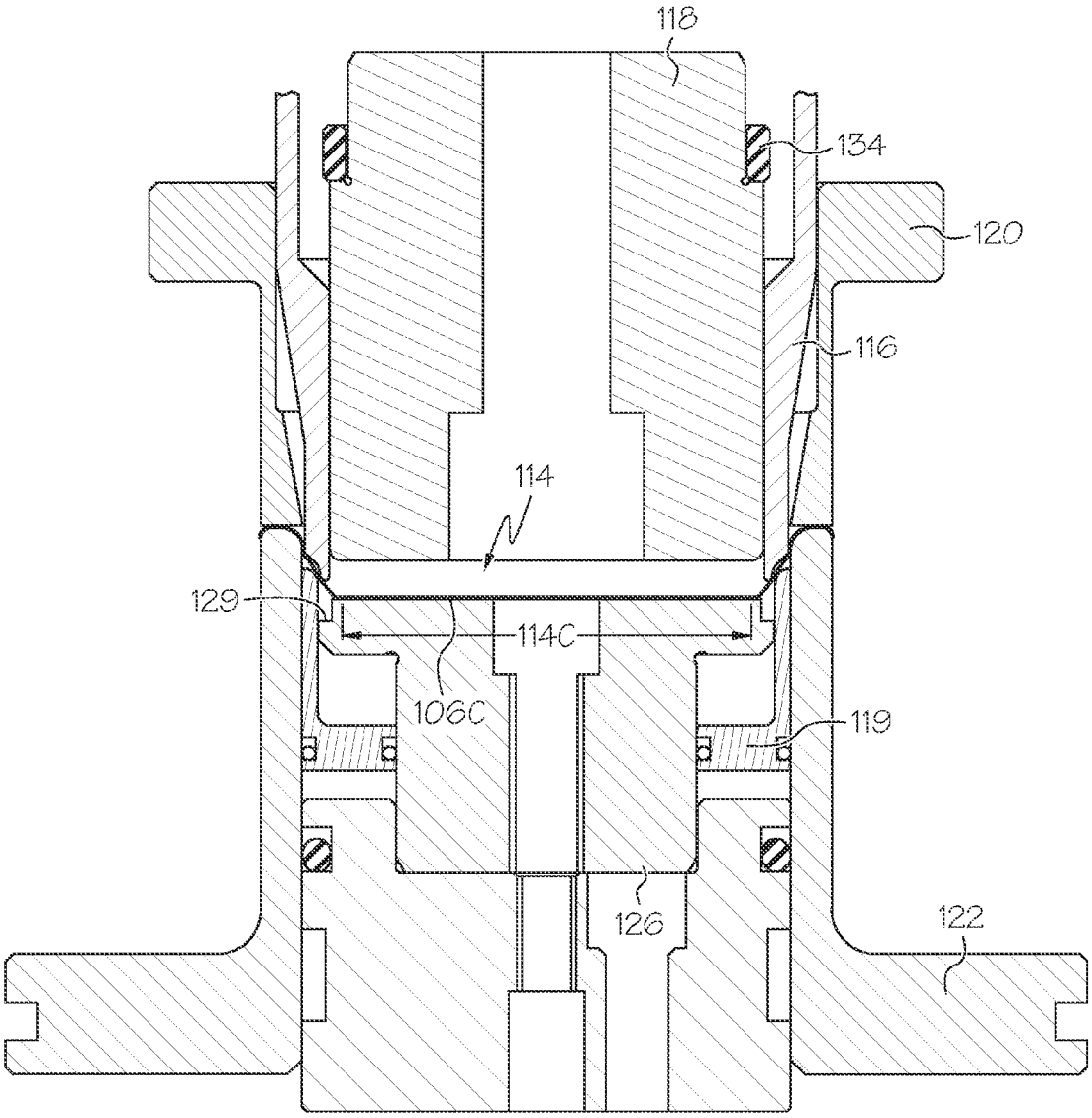
Figure 11:
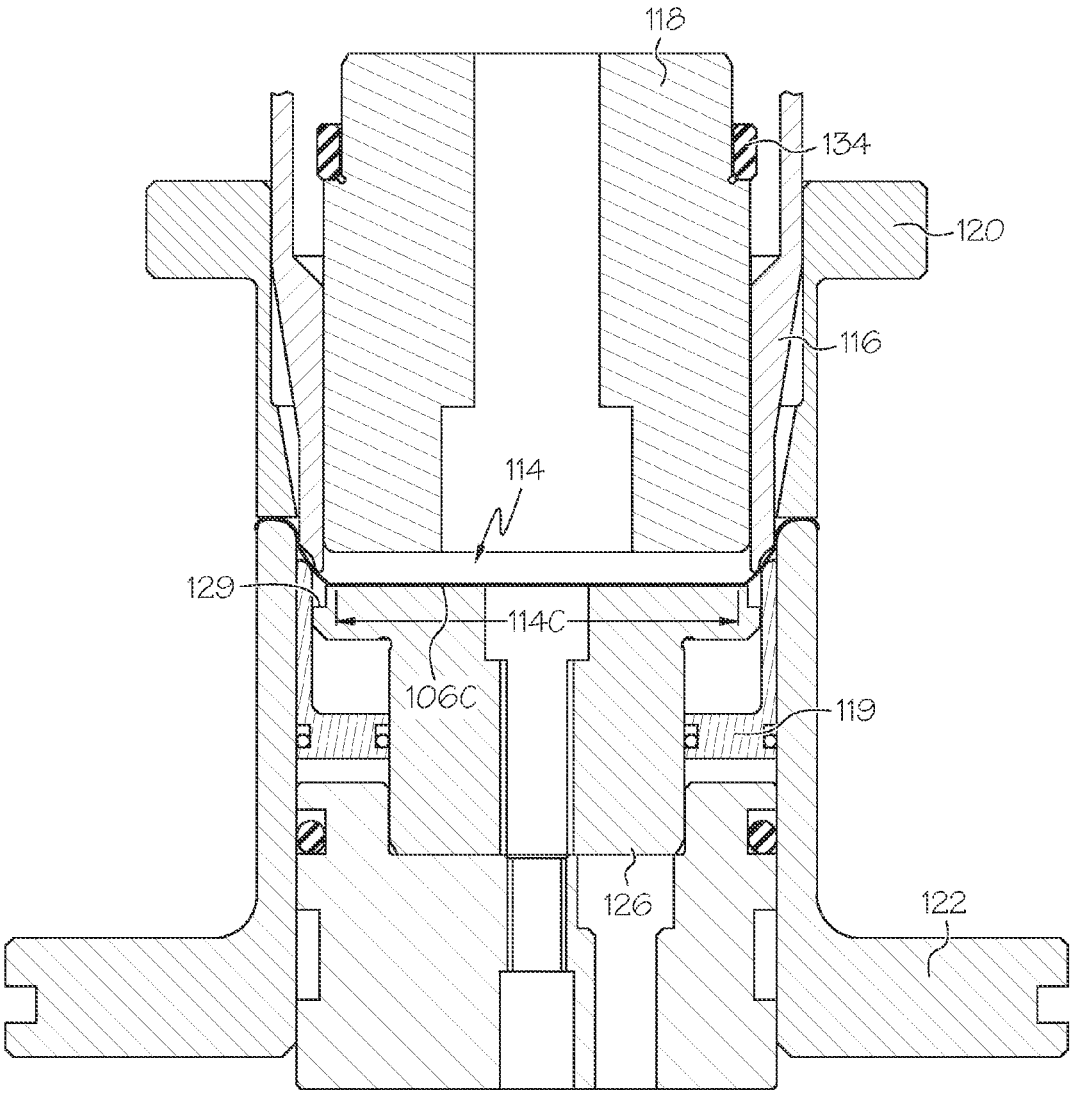
Figure 12:
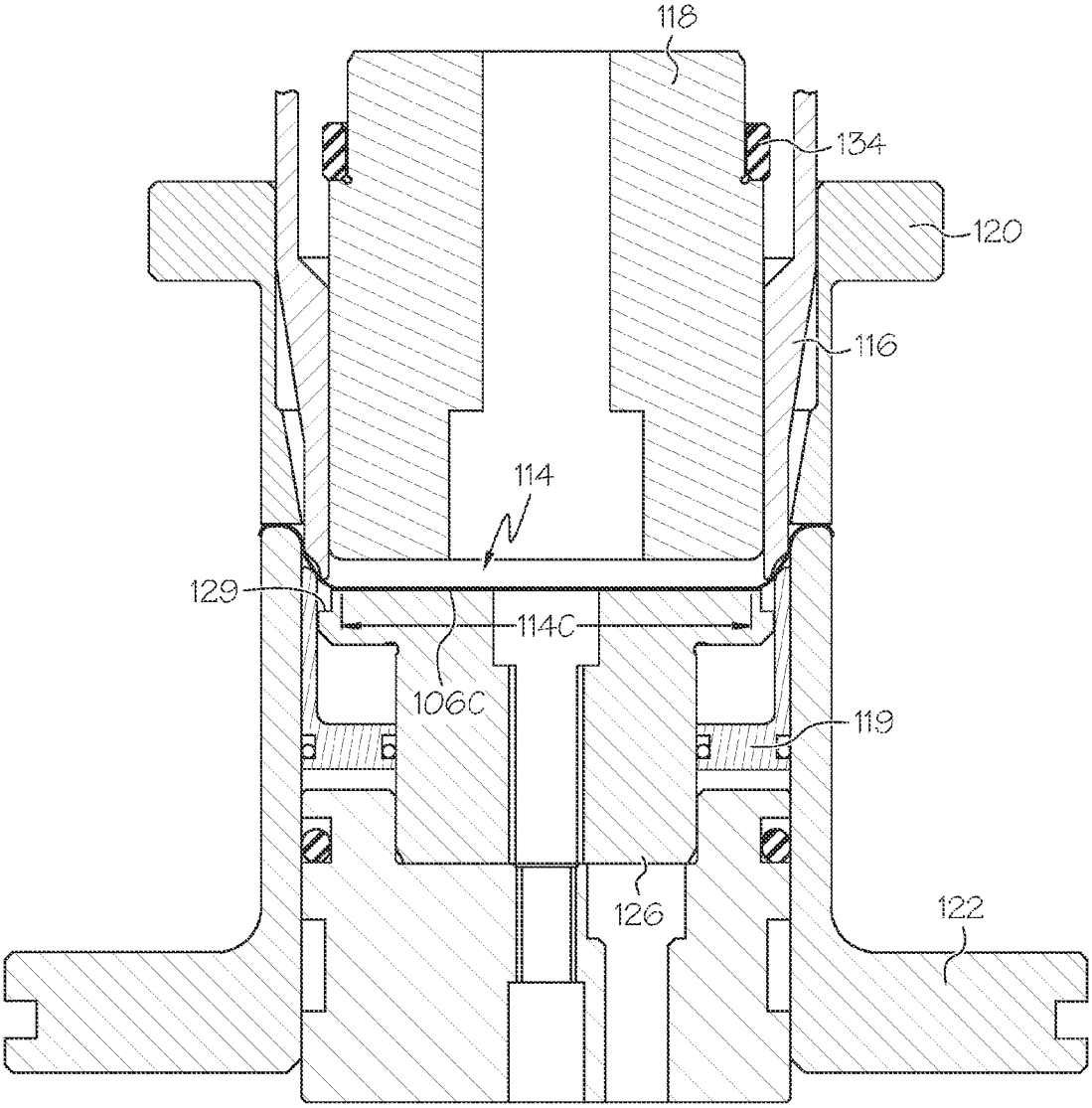
Figure 13:
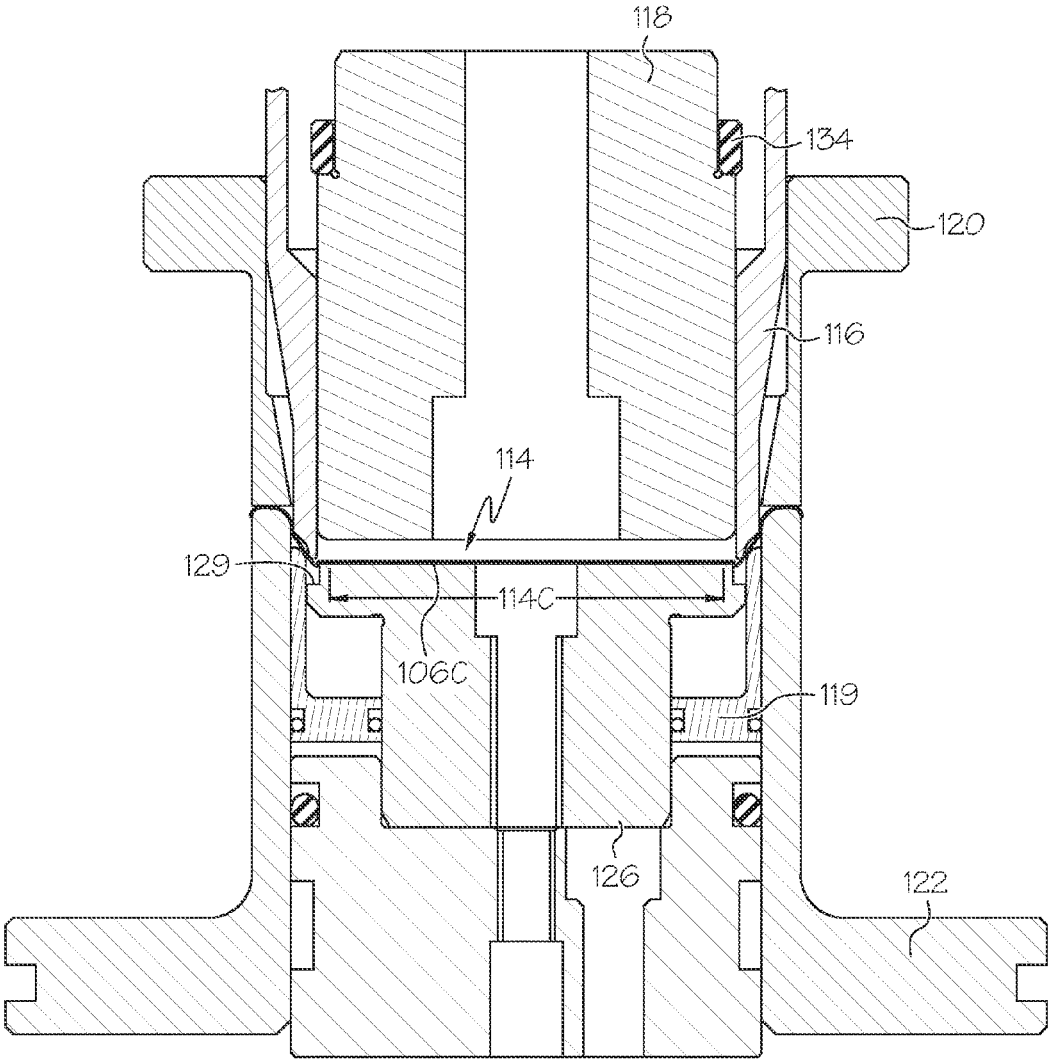
Figure 14:
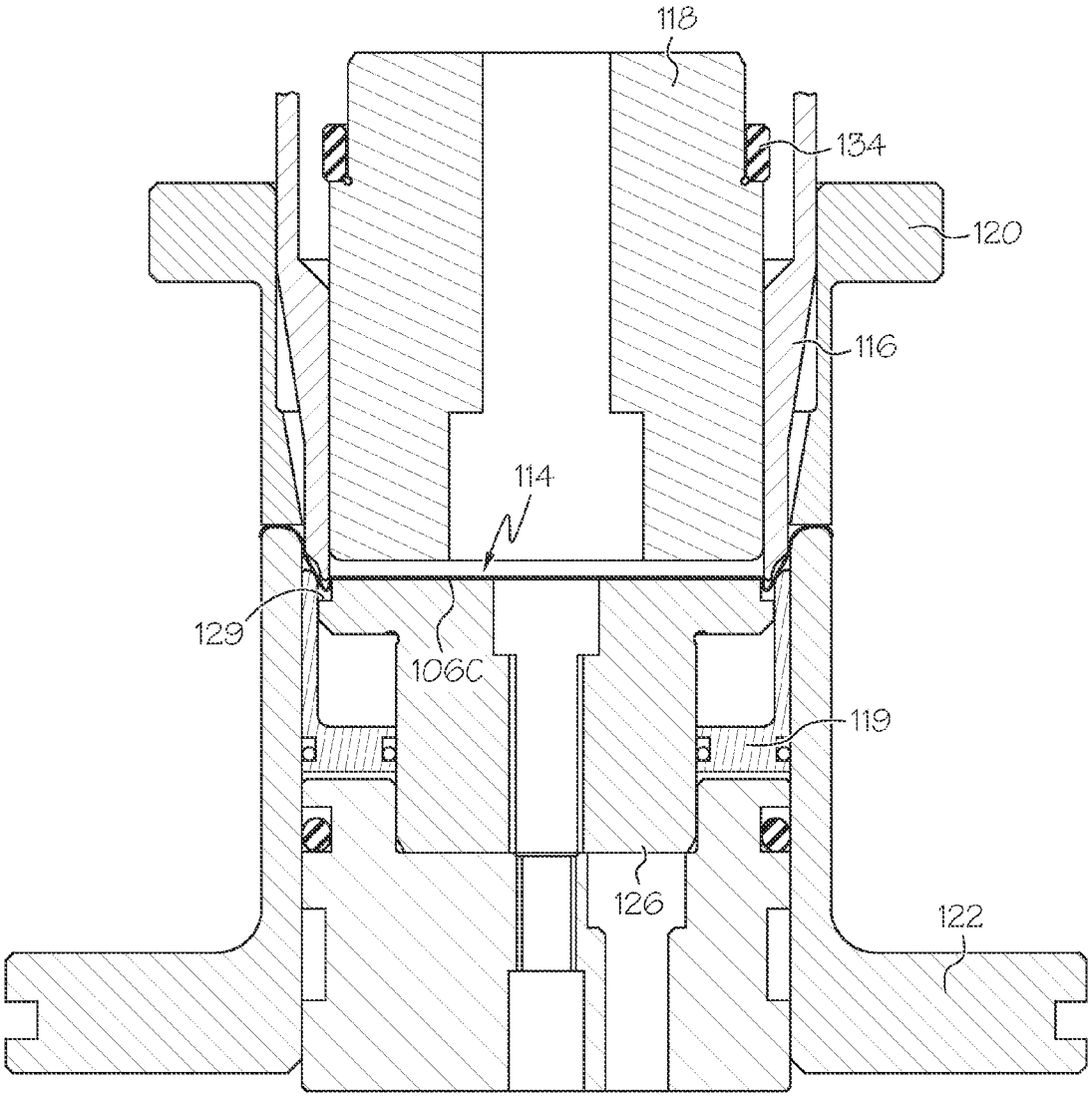
Figure 15:
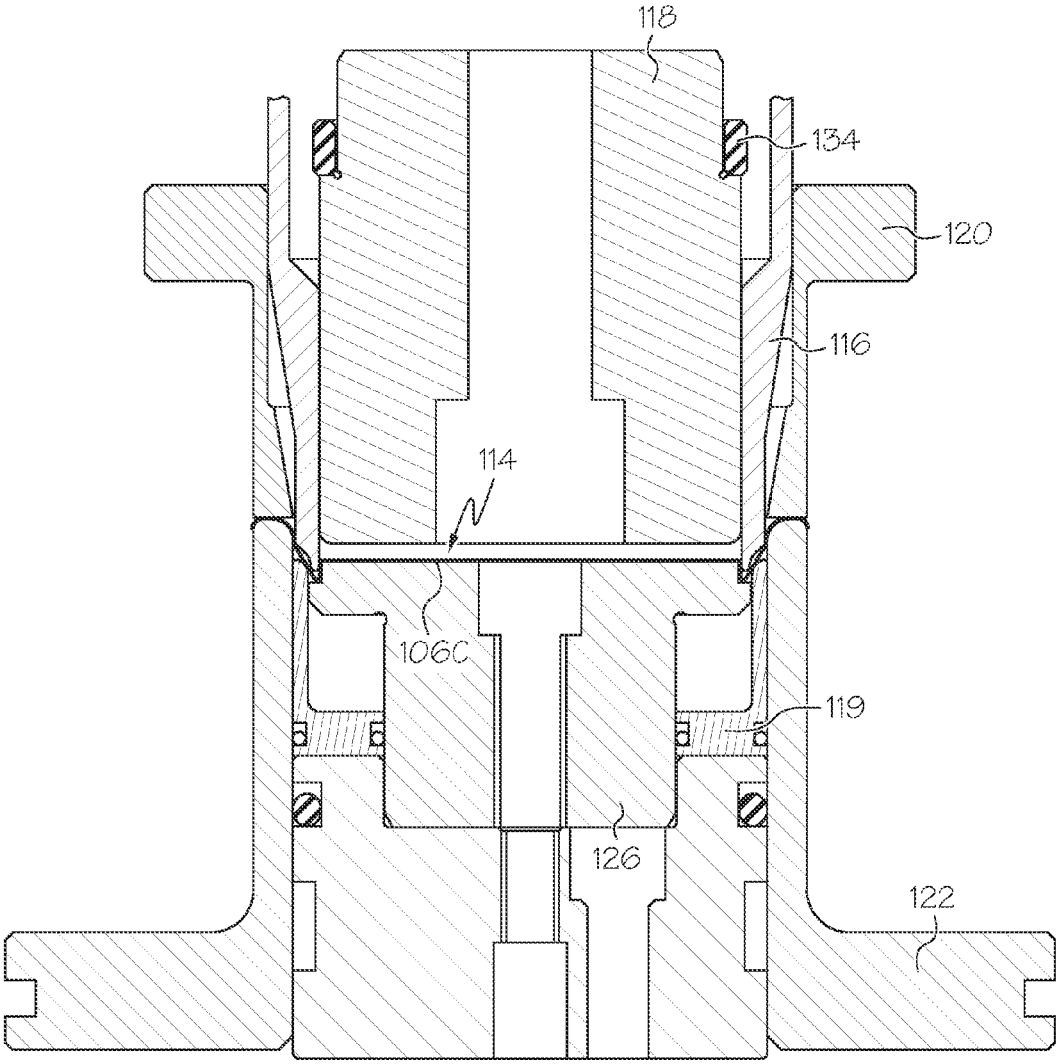
Figure 16:
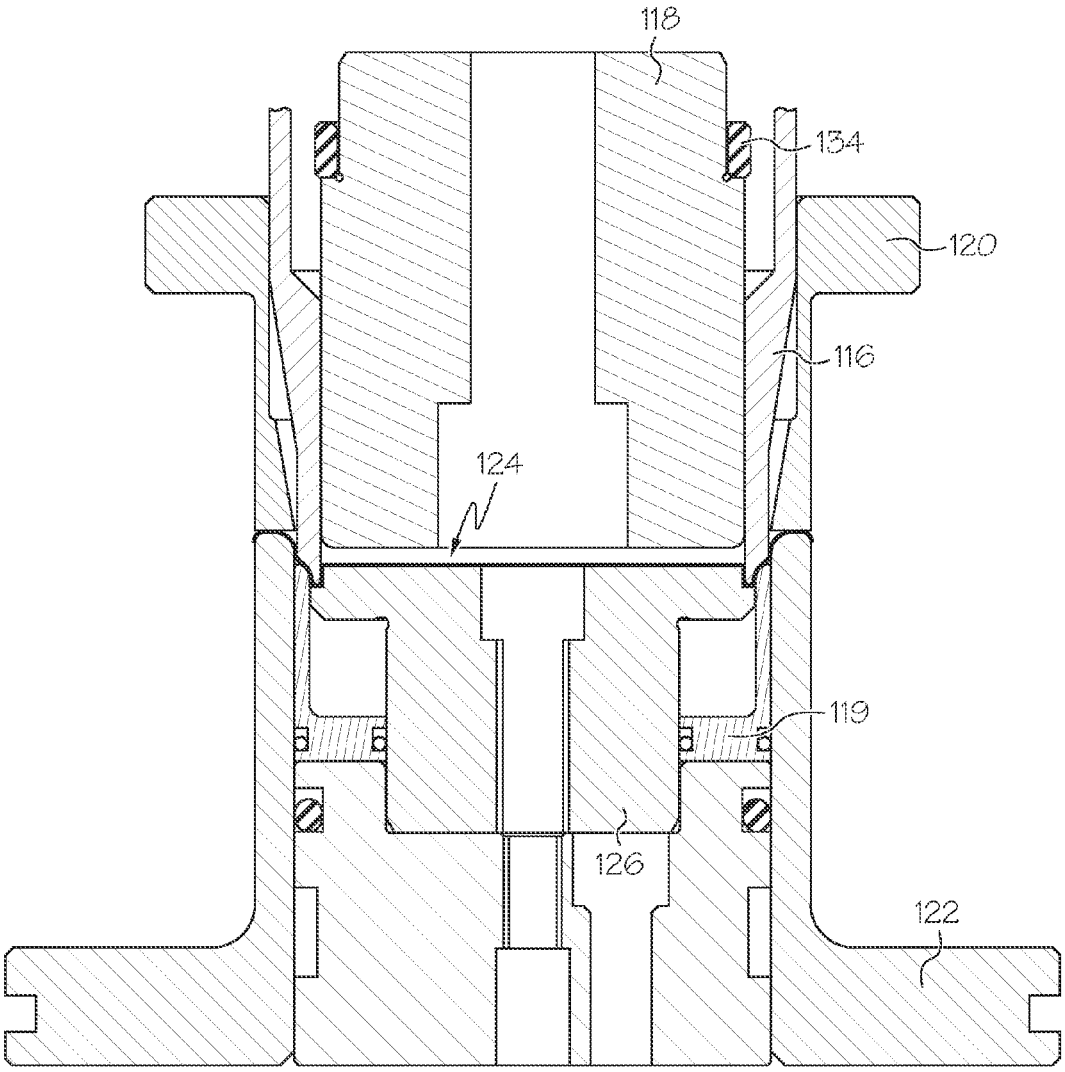

FIGS. 9 through 16 show the cupped can end blank 114 as the central portion of the cup is rolled up to finalize the can end 124 through free forming. FIG. 9 shows the cup 106C of the cupped can blank 114 as it is first contacted by the panel punch 126. FIGS. 10 through 14 show free forming of the material between the central portion 114C of the cup 106C and the clamped portion 114A of the cupped can end blank 114 as the central portion 114C of the cup 114 is rolled up. FIGS. 15 and 16 show the tooling including the die center 116 defining the final can end geometry during the very last portion of the down stroke of the tools in the upper punch assembly 102.

After the bottoming of the down stroke, the tooling moves upward and vacuum in the upper tooling holds the finished can end 124 onto the face of the knockout 120 from which it is discharged by air at the top of the operating stroke of the upper punch assembly 102.

Having thus described the invention of the present application in detail and by reference to embodiments thereof, it will be apparent that modifications and variations are possible without departing from the scope of the invention defined in the appended claims.

What is claimed is:

1. A method for forming a can end with controlled thinning of formed portions of the can end, the method comprising:

cutting a can end blank from a sheet of material in a forming press;

clamping a portion of the can end blank between a first tool and a second tool in a generally horizontal orientation;

providing a third tool carried by an upper punch assembly of the forming press;

controlling a fourth tool independently of other tools of the forming press to move between an extended position and a retracted position;

extending the fourth tool;

forming a cup in the can end blank with the fourth tool and a fifth tool to form a cupped can end blank;

clamping a portion of the cupped can end blank between a sixth tool and a seventh tool;

retracting the fourth tool;

contacting a central portion of an outer surface of the cup with an eighth tool to hold the central portion of the cup stationary as the clamped portion of the cupped can end blank is moved downward so that the material between the central portion of the cup and the clamped portion of the cupped can end blank is free formed with limited contact with any of the tools; and providing a lower shelf on the eighth tool to prevent overextension of free formed material, wherein the third tool, the fifth tool, the seventh tool and the eighth tool define a final geometry of the free formed portion of the cupped can end blank at the bottom of the forming stroke of the forming press.

2. The method for forming a can end with controlled thinning of formed portions of the can end as claimed in claim 1 wherein controlling the fourth tool comprises:

connecting a double acting piston of the forming press to the fourth tool;

providing a force on a first side of the piston to retract the fourth tool; and controlling pressure in a piston control chamber on a second side of the piston opposite to the first side to extend the fourth tool.

3. The method for forming a can end with controlled thinning of formed portions of the can end as claimed in claim 2 further comprising positioning the fourth tool within the forming press in accordance with material required to be free formed within the forming press.

4. The method for forming a can end with controlled thinning of formed portions of the can end as claimed in claim 3 wherein positioning the fourth tool within the forming press comprises spacing the fourth tool relative to the double acting piston of the forming press.

5. The method for forming a can end with controlled thinning of formed portions of the can end as claimed in claim 4 wherein spacing the fourth tool relative to the double acting piston of the forming press comprises selecting a spacer that extends between the fourth tool and the double acting piston of the forming press.

6. The method for forming a can end with controlled thinning of formed portions of the can end as claimed in claim 1 wherein providing the lower shelf on the eighth tool to prevent overextension of the free formed material comprises recessing an outer portion of the eighth tool to a depth so that free formed material contacts the lower shelf, if at all, at the bottom of the forming stroke of the forming press.

7. The method for forming a can end with controlled thinning of formed portions of the can end as claimed in claim 6 wherein recessing the outer portion of the eighth tool is such that free formed material contacts the lower shelf, if at all, during about a final 0.002 to 0.004 inch of the forming stroke of the forming press.

8. A method for forming a can end with controlled thinning of formed portions of the can end, the method comprising:

cutting a can end blank from a sheet of material in a forming press;

clamping a peripheral portion of the can end blank in a generally horizontal orientation;

providing tooling including a pre-panel punch movable between an extended position and a retracted position;

forming a cup in the can end blank with the tooling including the pre-panel punch in its extended position to form a cupped can end blank;

clamping a peripheral portion of the cupped can end blank in a generally horizontal orientation;

moving the pre-panel punch to its retracted position;

contacting a central portion of an outer surface of the cup with a panel punch to hold the central portion of the cup stationary as the clamped portion of the cupped can end blank is moved downward so that the material between the central portion of the cup and the clamped portion of the cupped can end blank is free formed with limited contact with any tooling of the forming press;

providing a lower shelf on the panel punch to prevent overextension of free formed material; and forming a final geometry of free formed material as the forming press reaches a bottom of a forming stroke.

9. An apparatus for forming a can end in a forming press having a fixed base and an upper punch assembly movable relative to the fixed base, the apparatus operating so that thinning of formed portions of the can end is controlled, the apparatus comprising:

a draw punch carried by the upper punch assembly of the forming press;

a draw pad supported for movement in the fixed base of the forming press, the draw punch and draw pad being aligned with one another for clamping a peripheral portion of a can end blank;

a pre-panel punch carried by a dual action piston of the upper punch assembly of the forming press;

a die center carried by the upper punch assembly of the forming press, the die center surrounding the pre-panel punch which is controlled to move relative to the die center between an extended position and a retracted position, the pre-panel punch in its extended position engaging the can end blank as the can end blank is clamped between the draw punch and draw pad to form a cup in the can end blank to form a cupped can end blank;

a crown ring supported for movement in the fixed base of the forming press and having an upper surface defining a contour for a crown of the can end;

a knockout carried by the upper punch assembly, the knockout being aligned with the crown ring for engaging a peripheral portion of the cupped can end blank so that the cupped can end blank is clamped between the knockout and the crown ring with an outer surface of the cup extending toward the fixed base;

a panel punch mounted to the fixed base; and an inner form die movably mounted in the fixed base and surrounding the panel punch which is positioned and sized so that it contacts a central portion of the outer surface of the cup of the cupped can end blank to hold the central portion of the cup stationary as the clamped portion of the cupped can end blank is moved downward so that material between the central portion of the cup and the clamped portion of the cupped can end blank is free formed with limited contact with any tooling of the forming press, the pre-panel punch being retracted after formation of the cupped can end blank so that the die center extends beyond the pre-panel punch to partially define a final geometry of the free formed material, the final geometry of the free formed material being formed as the forming press reaches a bottom of its forming stroke.

10. The apparatus for forming a can end in a forming press having a fixed base and an upper punch assembly moved relative to the fixed base, the apparatus operating so that thinning of formed portions of the can end is controlled as claimed in claim 9 further comprising a lower shelf positioned to prevent overextension of free formed material.

11. The apparatus for forming a can end in a forming press having a fixed base and an upper punch assembly moved relative to the fixed base, the apparatus operating so that thinning of formed portions of the can end is controlled as claimed in claim 10 wherein the lower shelf is formed on the panel punch.

12. The apparatus for forming a can end in a forming press having a fixed base and an upper punch assembly moved relative to the fixed base, the apparatus operating so that thinning of formed portions of the can end is controlled as claimed in claim 11 wherein the lower shelf comprises a recessed outer peripheral portion of the panel punch.

13. The apparatus for forming a can end in a forming press having a fixed base and an upper punch assembly moved relative to the fixed base, the apparatus operating so that thinning of formed portions of the can end is controlled as claimed in claim 9 wherein the pre-panel punch is positioned within the upper punch assembly of the forming press in accordance with an amount of material required to be free formed within the forming press.

14. The apparatus for forming a can end in a forming press having a fixed base and an upper punch assembly moved relative to the fixed base, the apparatus operating so that thinning of formed portions of the can end is controlled as claimed in claim 13 further comprising a spacer between the pre-panel punch and the dual action piston of the upper punch assembly of the forming press to position the pre-panel punch within the upper punch assembly of the forming press.

* * * * *